US006493945B1

(12) United States Patent
DeRosa et al.

(10) Patent No.: US 6,493,945 B1
(45) Date of Patent: Dec. 17, 2002

(54) CUTTING TOOL

(75) Inventors: Thomas DeRosa, 500-E Falls Blvd., No. 5132, Quincy, MA (US) 02169; Todd E. Kleperis, Plymouth, MA (US)

(73) Assignee: Thomas DeRosa, Oxford, CT (US)

( * ) Notice: Subject to any disclaimer, the term of this patent is extended or adjusted under 35 U.S.C. 154(b) by 0 days.

(21) Appl. No.: 09/154,888

(22) Filed: Sep. 17, 1998

Related U.S. Application Data

(60) Provisional application No. 60/059,206, filed on Sep. 18, 1997.

(51) Int. Cl.[7] ..... D06H 7/00; B26B 29/02

(52) U.S. Cl. ..... 30/286; 30/294; 30/317

(58) Field of Search ..... 30/2, 294, 317, 30/DIG. 3, 280, 314, 286, 289, 295, DIG. 8; D7/695

(56) References Cited

U.S. PATENT DOCUMENTS 642,689 A * 2/1900 Garllus ..... 30/294
814,153 A * 3/1906 Myer et al. ..... 30/294 X
1,546,975 A * 7/1925 Feller ..... 30/2
3,178,812 A * 4/1965 Lurie ..... 30/289 X
4,198,751 A * 4/1980 Egbert ..... 30/317 X
5,412,871 A * 5/1995 Reyburn et al. ..... 30/2
5,590,471 A * 1/1997 Wiezenthal ..... 30/DIG. 3 X
5,829,321 A * 11/1998 Domenico ..... 30/294 X

FOREIGN PATENT DOCUMENTS

FR 2 392 164 * 1/1979 ..... 30/317

* cited by examiner

*Primary Examiner*—Clark F. Dexter
(74) *Attorney, Agent, or Firm*—Thomas DeRosa

(57) ABSTRACT

A planar hook-shaped cutting tool for cutting sheet material is disclosed. The tool has a recessed cutting blade and a ball point end to protect underlying materials. The tool is most useful for quickly cutting articles of clothing from a person's body.

9 Claims, 4 Drawing Sheets

CUTTING TOOL

This application claims the benefit of provisional application No. 60/059,206, filed Sep. 18, 1997.

FIELD OF THE INVENTION

This invention relates to a device for cutting fabric or similar sheet material. More particularly, it relates to a tool for quickly and safely cutting clothing from a person's body.

BACKGROUND OF THE INVENTION

There always exists a need to safely and quickly cut and remove clothing or fabric from a person's body, particularly in emergency room situations where removing articles of clothing needs to be done quickly and safely. Patients with burns, gun shot wounds or those involved in some other trauma injury often require clothing removal in order for doctors and nurses to treat the injured individual.

Currently, the most widely practiced method for removal of clothing is by cutting the article with rounded tip surgical scissors to avoid further injury to the patient. Often an initial cut must be made in the clothing to allow entry of the scissors blade to begin the cutting operation. Both processes are time consuming, and the whole process becomes even more difficult if the patient is moving or having convulsions.

Thus there exists an unmet need for a device which can quickly and safely cut clothing from the body of a person.

SUMMARY OF THE INVENTION

The invention is a cutting tool for sheet materials comprising a planar hook-shaped cylindrical member having a longer linear handle section with a longitudinal axis, a semicircular curved transverse section connected coaxially at a first end to one end of the handle section and connected coaxially at a second end to one end of a shorter leg section. The leg section is oriented essentially parallel to the handle section, and extends to a ball point leg section at an end opposite the curved transverse section. A planar blade member is secured to the semicircular curved transverse section and the shorter leg section and positioned coplanar with the hook-shaped cylindrical member. The blade member has a cutting edge positioned in opposition to the cylindrical handle section.

DESCRIPTION OF THE PREFERRED EMBODIMENTS

Figure 1:
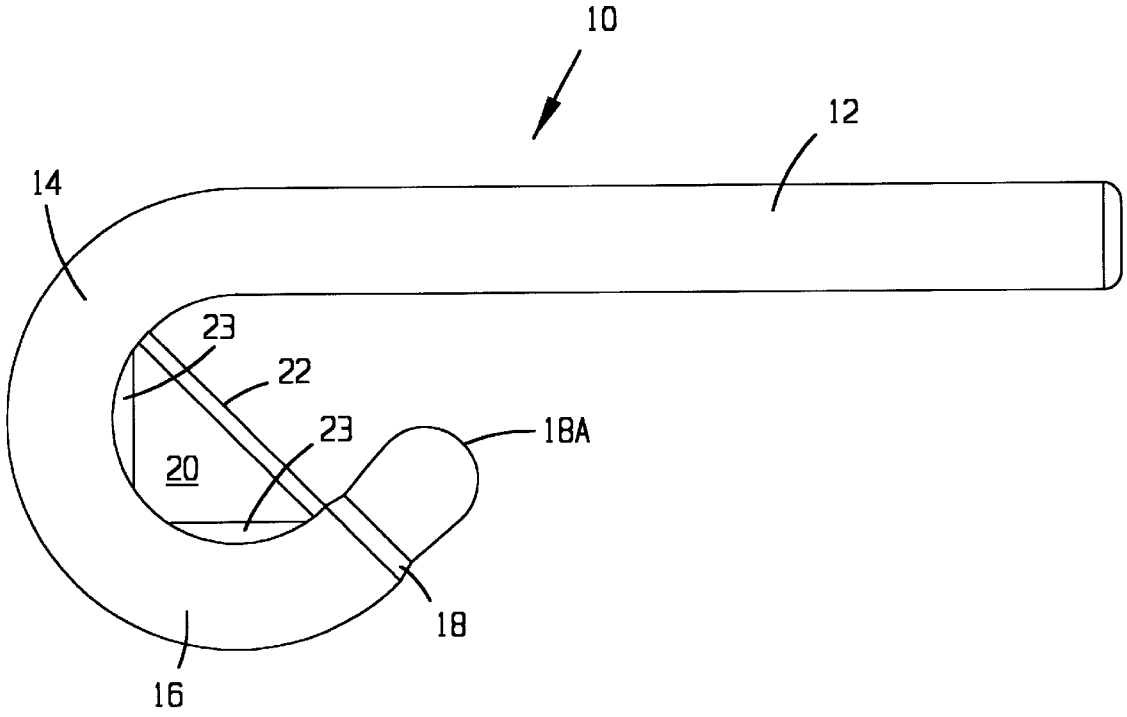
FIG. 1 is a plan view of one embodiment of the present invention.

Construction:

Referring to FIG. 1, the cutting tool of the present invention is shown. The tool comprises a planar hook-shaped cylindrical member 10 having a longer linear handle section 12 with a longitudinal axis. A semicircular curved transverse section 14 is connected coaxially at a first end to one end of the handle section 12. A cylindrical leg section 16 is also connected coaxially at one end to a second end of the semicircular section 14 such that the shorter leg section 16 is oriented essentially parallel to the longitudinal axis of the handle section 12. The end of the leg section 16 opposite the semicircular section 14 extends to a ball point leg section 18 which extends toward the handle section 12 and includes a ball point portion 18A at an end thereof.

A planar blade member 20 is secured to the semicircular curved transverse section 14 and the shorter leg section 16 in a coplanar orientation with these sections. The cutting edge 22 of the blade member 20 is positioned in opposition to the cylindrical handle section 12 of the tool. The blade member 20 may be positioned upon and secured to the surface of the planar hook-shaped member. However, it is preferred that the blade member 20 be secured within an aperture slit 23 positioned in the inside circumferencial surface formed by the semicircular section 14 and shorter leg section 16. To access the aperture slit 23 which holds the blade member 20 in position, the ball point leg section 18 of the tool is removably connected by screw treads to the end of leg section 16 such that said cutting edge faces said handle section. Thus, the blade member 20 can be replaced by unscrewing the ball point leg section 18 and inserting a new blade member 20, then reattaching the ball point leg section 18 to the end of leg section 16.

Although the cutting edge 22 of the blade member 20 may be at an oblique, a right or an acute angle orientation relative to the handle section 12, the cutting edge 22 of the blade member 20 is preferably oriented at about a 45 degree angle relative to the longitudinal cylindrical axis of the longer handle section 12 of the tool. It is also preferred that the ball point leg section 18 at the end of the shorter leg section 16 be oriented to extend toward the longer handle section 12 of the tool.

The cutting tool of the present invention is most useful for cutting the clothes from a person's body in emergency or trauma situations. The tool is sized to be grasped and operated by one hand of the user. The operator of the tool, usually medical or paramedic personnel, grasps the tool by the longer handle section 12 and inserts the shorter leg section 16 and the ball point leg section 18 into an opening in the article of clothing to be removed. As the operator pulls on the handle end 12 of the tool 10, the clothing fabric is drawn against the blade edge 22 and severed. It may be necessary for the operator to first cut an opening in the piece of clothing to be removed, or an already existing opening can be used.

The design of the cutting tool is unique in that the ball point end portion 18A moves with little resistance over the underlying skin or clothing of the individual as the operator inserts the tool into an opening therein. The user inserts the ball point end portion 18A into an opening in a hooking movement and starts to draw the tool along. As the operator draws the tool along the cutting path, the ball point end portion 18A lifts the fabric off of the underlying surface before the fabric reaches the cutting blade 20. Further, the outer circumferential surface of the semicircular curved section 14 and the leg section 16 slides over the underlying skin or clothing with little effort.

The materials of construction of the hook-shaped member 10 may be a stainless steel alloy or similar metal. The metal blade 20 is preferably replaceable for such a tool. Alternatively, the hook-shaped member 10 may be formed of a synthetic polymer material with the blade member 20 integrally molded within the cylindrical member. A number of suitable polymers, such as nylon or polypropylene, are well known in the art. Such a tool made of plastic with a metal blade would be considered disposable.

Figure 2:
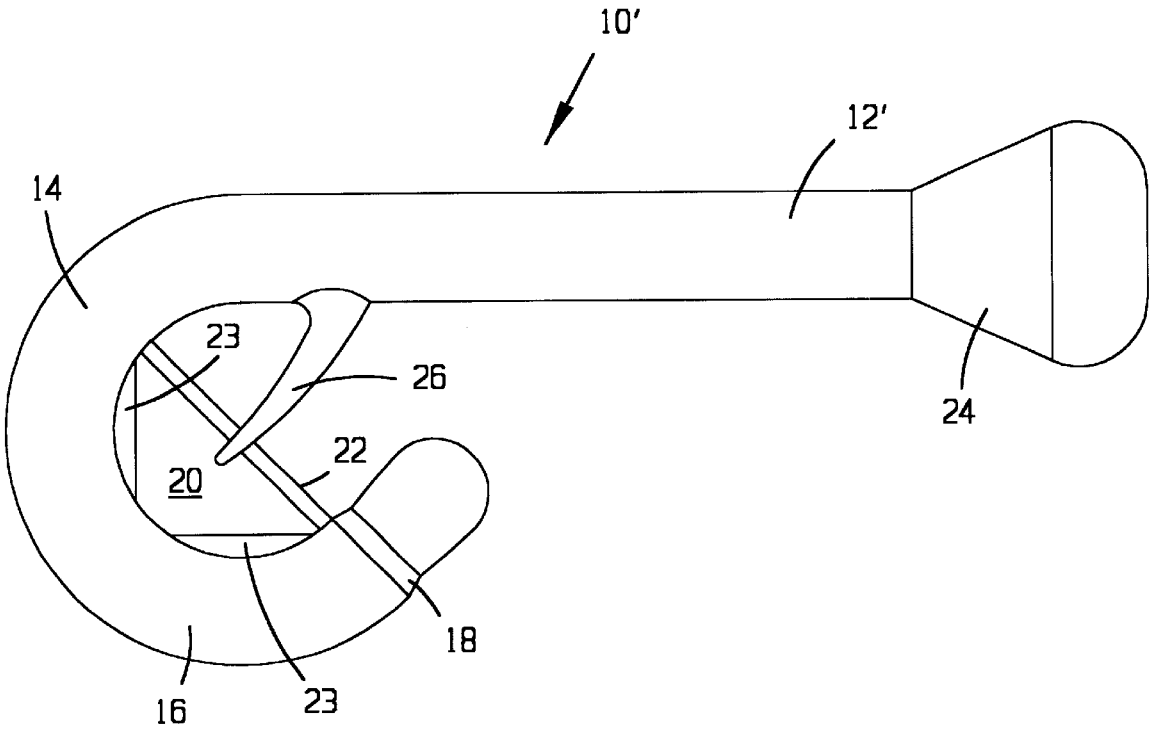
FIG. 2 is a plan view of a further embodiment of the present invention.

An alternative embodiment of the invention is shown in FIG. 2. In addition to the basic members shown in FIG. 1, the embodiment of FIG. 2 has a hook shaped member 10 which includes an enlarged end portion 24 secured to the end of the handle section 12 at the end opposite the semicircular section 14 of the tool. This additional element provides for improved grip as the operator pulls the tool along the cutting line. Also included in this embodiment is a biasing means attached to the longer handle section 12 to direct the fabric material to be cut against the blade cutting edge 22. The biasing means in this embodiment is a flexible spring member 26 positioned in the plane of the hook-shaped member, and extending from the handle section 12 to nearly contact the shorter leg section 16.

Figure 3:
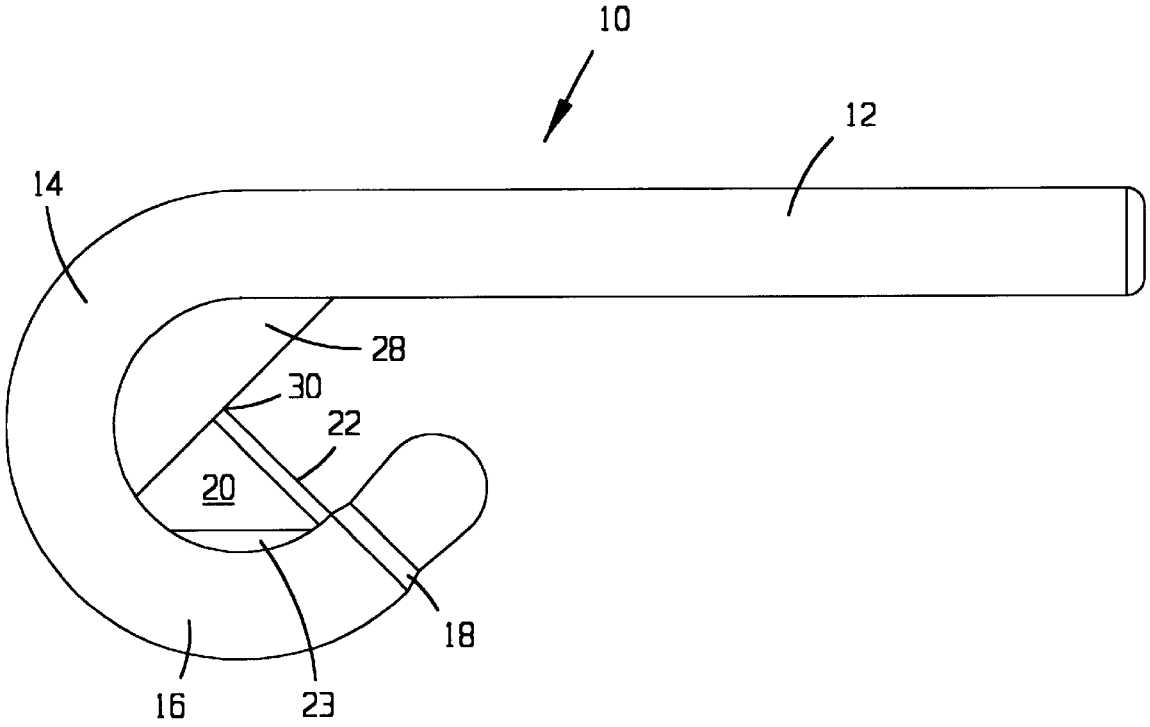
FIG. 3 is a plan view of a further embodiment of the present invention.
Figure 4A:
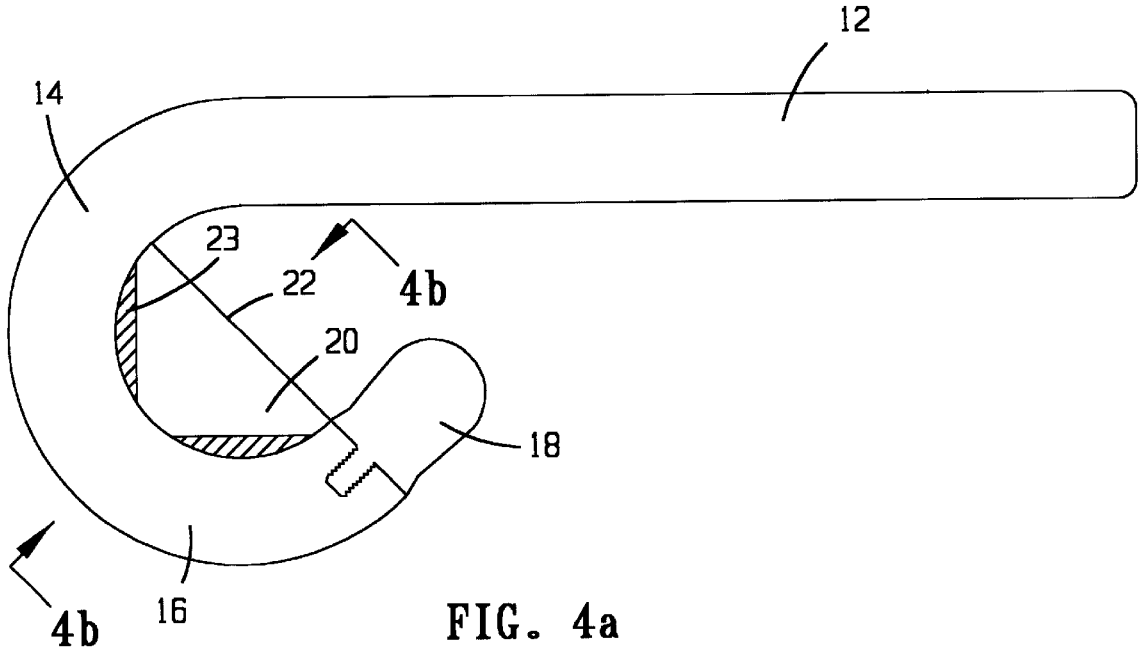
FIG. 4*a* is a cross sectional view of the tool along its longitudinal axis.
Figure 4B:
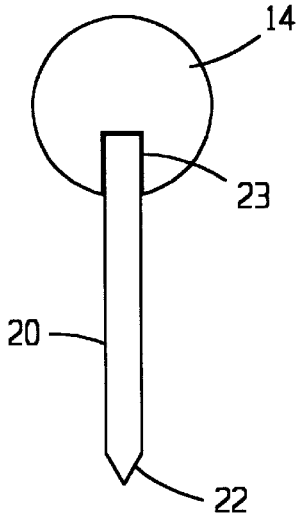
FIG. 4*b* is a cross sectional view of the tool perpendicular to its longitudinal axis.

An alternative embodiment of the invention is shown in FIG. 3. In addition to the basic members shown in FIG. 1, the embodiment of FIG. 3 includes a blade guard member 28 which is positioned in the blade holding aperture 23 located in the inside circumferencial surface of the tool member 10. The guard member 28 is a planar semicircular device which also has a slit aperture 30 sized to accept a portion of blade member 20. The circular edge of the flat blade guard member 28 fits into a portion of the aperture 23 located in the inside circumnferencial surface of the tool member. The straight edge of the guard is oriented at an oblique angle relative to the linear handle section 12, and at about a right angle to the cutting edge 22 of the blade member 20. The guard member 28 may be made of the same metal alloy as the tool member, or preferably is made of synthetic polymer or plastic. The blade guard 28 not only reduces the length of the cutting edge 22 exposed, it also functions as a biasing means to urge the sheet material being severed against the cutting edge 22 of the tool.

Although the cutting tool is well adapted to cutting clothing from a person, it is also useful for cutting a wide variety of sheet material, such as carpeting, plastic packaging, cardboard, paper and the like.

While the invention has been particularly shown and described with reference to a preferred embodiment thereof, it will be understood by those skilled in the art that various changes in form and details may be made therein without departing from the spirit and scope of the invention.

We claim:

1. A cutting tool comprising;

a) a planar hook-shaped cylindrical member having a linear cylindrical handle section with a longitudinal axis, a cylindrical semicircular curved transverse section connected coaxially at a first end to one end of said handle section and connected coaxially at a second end to one end of a short cylindrical leg section, said short leg section being shorter than and oriented essentially parallel to said handle section, said short leg section extending to a ball point portion at an end opposite said curved transverse section, with said ball point leg section extending toward said linear handle portion and terminating in a ball point portion; and b) a planar blade member secured to said cylindrical semicircular curved transverse section and to said short cylindrical leg section and positioned coplanar therewith, said blade member having a cutting edge positioned in opposition to said linear cylindrical handle section.

2. A cutting tool according to claim 1 wherein said cutting edge of said blade member is oriented at about a 45 degree angle relative to said longitudinal axis of said linear cylindrical handle section of said tool.

3. A cutting tool according to claim 1 wherein said blade member is secured within an aperture slit positioned on an inside circumferential surface of each of said cylindrical curved transverse section and said short cylindrical leg section.

4. A cutting tool according to claim 3 further comprising a guard member secured within said aperture slit, said guard member covering a portion of said blade member.

5. A cutting tool according to claim 1 wherein said hook-shaped cylindrical member is constructed of a stainless steel alloy.

6. A cutting tool according to claim 1 wherein said hook-shaped cylindrical member is constructed of a synthetic polymer material.

7. A cutting tool according to claim 1 further comprising biasing means attached to said linear cylindrical handle section to direct material to be cut against said blade member.

8. A cutting tool according to claim 1 further comprising said linear cylindrical handle section having an enlarged portion positioned at an end opposite said semicircular transverse section.

9. A cutting tool according to claim 1 wherein said ball point leg section is removably attached by screw thread means to said short leg section.

* * * * *